US007207841B2

(12) United States Patent
Machida et al.

(10) Patent No.: US 7,207,841 B2
(45) Date of Patent: Apr. 24, 2007

(54) ELECTRICAL CONNECTOR

(75) Inventors: Yukifumi Machida, Tokyo (JP); Shinji Yamaguchi, Tokyo (JP); Yoshikazu Tanaka, Tokyo (JP); Takayuki Higuchi, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 10/529,336

(22) PCT Filed: Sep. 11, 2003

(86) PCT No.: PCT/JP03/11662

§ 371 (c)(1),
(2), (4) Date: Oct. 24, 2005

(87) PCT Pub. No.: WO2004/030156

PCT Pub. Date: Apr. 8, 2004

(65) Prior Publication Data

US 2006/0141862 A1 Jun. 29, 2006

(30) Foreign Application Priority Data

Sep. 25, 2002 (JP) ..... 2002-278394
Nov. 21, 2002 (JP) ..... 2002-338157

(51) Int. Cl.
*H01R 13/40* (2006.01)

(52) U.S. Cl. ..... 439/595

(58) Field of Classification Search ..... 439/595, 439/352, 752

See application file for complete search history.

(56) References Cited

U.S. PATENT DOCUMENTS 5,730,626 A * 3/1998 Tomita et al. ..... 439/595
5,904,593 A * 5/1999 Saito et al. ..... 439/595
6,048,226 A 4/2000 Iwahori
2001/0002347 A1* 5/2001 Yoshida et al. ..... 439/595
2001/0006861 A1* 7/2001 Ohsumi ..... 429/752
2002/0076992 A1 6/2002 Kurimoto et al.
2002/0127913 A1* 9/2002 Ichio ..... 439/595
2002/0142655 A1* 10/2002 Nimura et al. ..... 439/595
2002/0197913 A1 12/2002 Mase et al.
2003/0190841 A1* 10/2003 Nakamura et al. ..... 439/595
2004/0067686 A1* 4/2004 Nimura ..... 439/595
2004/0180576 A1* 9/2004 Hasebe ..... 439/595

FOREIGN PATENT DOCUMENTS

JP 4-22078 A 1/1992

(Continued)

*Primary Examiner*—Tulsidas C. Patel
*Assistant Examiner*—Vladimir Imas
(74) *Attorney, Agent, or Firm*—Frishauf, Holtz, Goodman & Chick, P.C.

(57) ABSTRACT

Upon releasing a locking arm from a connecting terminal by inserting a jig through a front holder, the jig could not be erroneously inserted into a terminal inserting hole. Connecting terminals are inserted into a housing, and the connecting terminals are prevented from being pulled out of the housing backwardly by means of locking arms arranged above the respective connecting terminals. The front holder is engaged with the housing by a clamping mechanism in an axial direction and is movable laterally in a direction perpendicular to the axial direction. A pair of terminal inserting holes and an arm operating hole 18 provided for respective connecting terminals are shifted laterally. In a first position of the front holder, the terminal inserting hole is aligned with an axial line of a female-type connecting terminal, but the arm operating hole is shifted laterally from the locking arm.

4 Claims, 7 Drawing Sheets

FOREIGN PATENT DOCUMENTS

| | | | |
|---|---|---|---|
| JP | 65036/1993 | | 6/1995 |
| JP | 10-289747 | A | 10/1998 |
| JP | 11-86948 | A | 3/1999 |
| JP | 2001-155812 | A | 6/2001 |
| JP | 2002-170623 | A | 6/2002 |
| JP | 2002-190339 | A | 7/2002 |
| JP | 2003-7386 | A | 1/2003 |

* cited by examiner

ELECTRICAL CONNECTOR

This application is a U.S. National Phase Application under 35 USC 371 of International Application PCT/JP2003/011662 filed Sep. 11, 2003.

TECHNICAL FIELD

The present invention relates to an electrical connector for use in, for example wire harnesses of automobiles.

TECHNICAL BACKGROUND (1) In a known electrical connector of the kind mentioned above, a plurality of connecting terminals each being connected to distal ends of respective electric wires are installed within a housing, and the connecting terminals are retained within the housing by means of locking arms formed integrally with the housing. Locking force of the locking arms can be positively enhanced by inserting a front holder 1 into a front portion of the housing as shown in FIG. 15.

In this case, when it is required to remove a connecting terminal from the housing 2, it is necessary to release a locking operation of an associated locking arm with the relevant connecting terminal. To this end, arm operating holes 4 through which a suitable jig may be inserted into the housing 2 from a front side thereof are formed in the front holder 1 in addition to terminal inserting holes 3 through which cooperating terminals are to be inserted into the housing.

(2) As illustrated in FIG. 16, in another known electrical connector of the kind mentioned above, a plurality of connecting terminals 5 each being connected to distal ends of respective electric wires are installed within a housing 6 and are retained therein by means of locking arms 7 formed integrally with the housing 6 such that the connecting terminals 5 could not be removed from the housing backwardly. Furthermore, when a front holder 8 is inserted into the housing 6 from its front side, pushing portions 9 of the front folder 8 push the locking arms 7 toward the connecting terminals 5. In this manner, the locking action of the locking arms 7 can be enhanced.

However, in the known electrical connector (1), the arm operating holes 4 formed in the front holder situate just above the terminal inserting holes 3, and therefore the jig for releasing an engagement of a locking arm with a connecting terminal might be inserted into a terminal inserting hole 3 to injure a connecting terminal, and furthermore cooperating connecting terminals might be erroneously inserted into the arm operating holes 4.

In the known electrical connector (2), when it is required to remove a connecting terminal 5 from the housing 6, the front holder 8 is first removed from the housing 6, and then a jig is inserted into the housing from a front side thereof to disengage an associated locking arm 7 from the connecting terminal 5. In this manner, during the operation of removing one or more connecting terminals by releasing the engagement of the locking arm or arms, the front holder 8 that has to be removed temporally from the housing 6 is liable to be lost.

The present invention has for its object to provide an electrical connector, in which the above mentioned problems can be removed and an engagement of a clamping arm with a connecting terminal can be released by inserting a jig into an arm operating hole by moving a front holder in a right and left fashion or in an up and down fashion relative to a housing without removing the front holder from the housing.

It is another object of the present invention to provide an electrical connector, in which a terminal inserting hole and an arm operating hole could not be used simultaneously to retain a safety in operation.

It is still another object of the invention to provide an electrical connector, in which connecting terminals installed within a housing can be pushed backward by a front holder to bring the connecting terminals firmly contacted with locking arms to prevent a rotational movement of the connecting terminals.

DISCLOSURE OF THE INVENTION

According to the present invention, an electrical connector comprising a housing accommodating connecting terminals connected to distal ends of electric wires, said housing including locking arms for retaining said connecting terminals not to remove from a backside of the housing, and a front holder inserted into a front portion of the housing such that said locking arms are urged against the connecting terminals to enhance a locking force of the locking arms, characterized in that said front holder is movable with respect to said housing between a first position and a second position in a direction perpendicular to an axial line of the housing; in said first position of the front holder, terminal inserting holes formed in the front housing are aligned with axial lines of the connecting terminals installed within the housing such that upon engaging a cooperating housing with the housing, an electrical connection between the connecting terminals installed within the housing and associated connecting terminals installed within the cooperating housing is attained; and in said second position of the front holder, the terminal connecting holes are shifted out of the axial lines of the connecting terminals installed within the housing and arm operating holes formed in the front holder are aligned with the locking arms.

According to further aspect of the present invention, an electrical connector comprising a housing accommodating connecting terminals connected to distal ends of electric wires, said housing including locking arms for retaining said connecting terminals not to remove from a backside of the housing, and a front holder inserted into a front portion of the housing such that said locking arms are urged against the connecting terminals to enhance a locking force of the locking arms, characterized in that said front holder is movable with respect to said housing between a first position and a second position in a direction perpendicular to an axial line of the housing; in said first position of the front holder, a cooperating housing is engaged with the housing to establish an electrical connection between the connecting terminals installed within the housing and associated connecting terminals installed within the cooperating housing and locking lances are urged against the connecting terminals; and said front holder includes arm pushing portions for releasing said locking lances in said second position of the front holder.

According to another aspect of the present invention, an electrical connector comprising a housing accommodating connecting terminals connected to distal ends of electric wires, said housing including locking arms for retaining said connecting terminals not to remove from a backside of the housing, and a front holder inserted into a front portion of the housing such that said locking arms are urged against the connecting terminals to enhance a locking force of the locking arms, characterized in that said front holder is movable with respect to said housing between a first position and a second position in a direction perpendicular to an axial line of the housing; in said first position of the front holder, a cooperating housing is engaged with the housing to establish an electrical connection between the connecting terminals installed within the housing and associated connecting terminals installed within the cooperating housing; and said front holder includes terminal pushing portions for pushing the connecting terminals backward during movement of the front holder from the first position to the second position such that a space is not formed between the locking arms and the connecting terminals in an axial direction.

BEST MODE OF THE INVENTION

Figure 1:
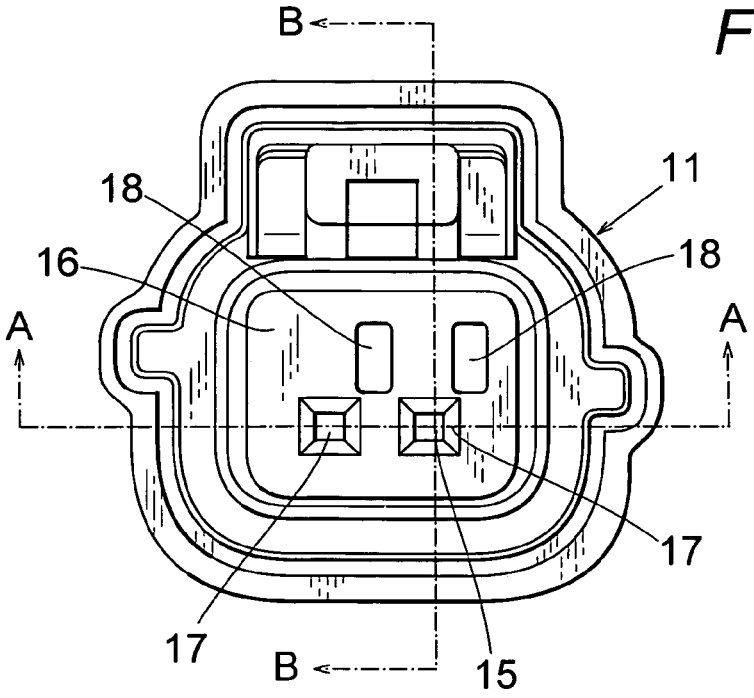
FIG. 1 is a front view of a first embodiment of the electrical connector according to the invention, while a front holder is in a first position.
Figure 2:
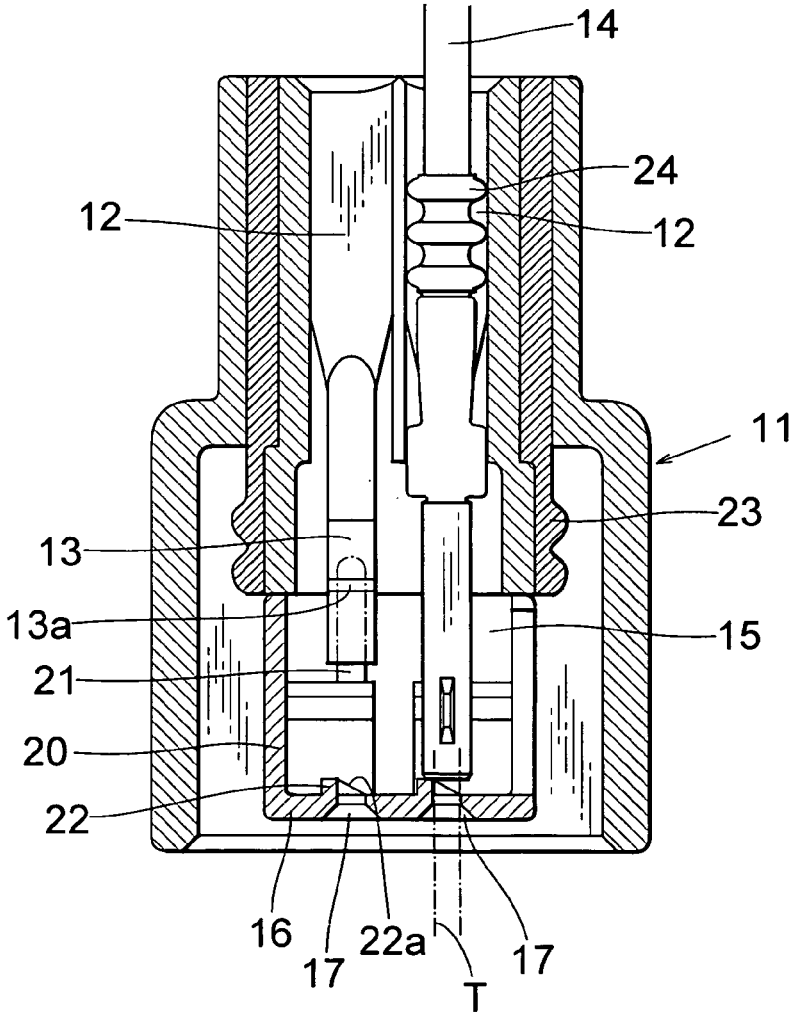
FIG. 2 is a cross sectional view cut along an A—A line in FIG. 1 showing the font holder and housing.
Figure 3:
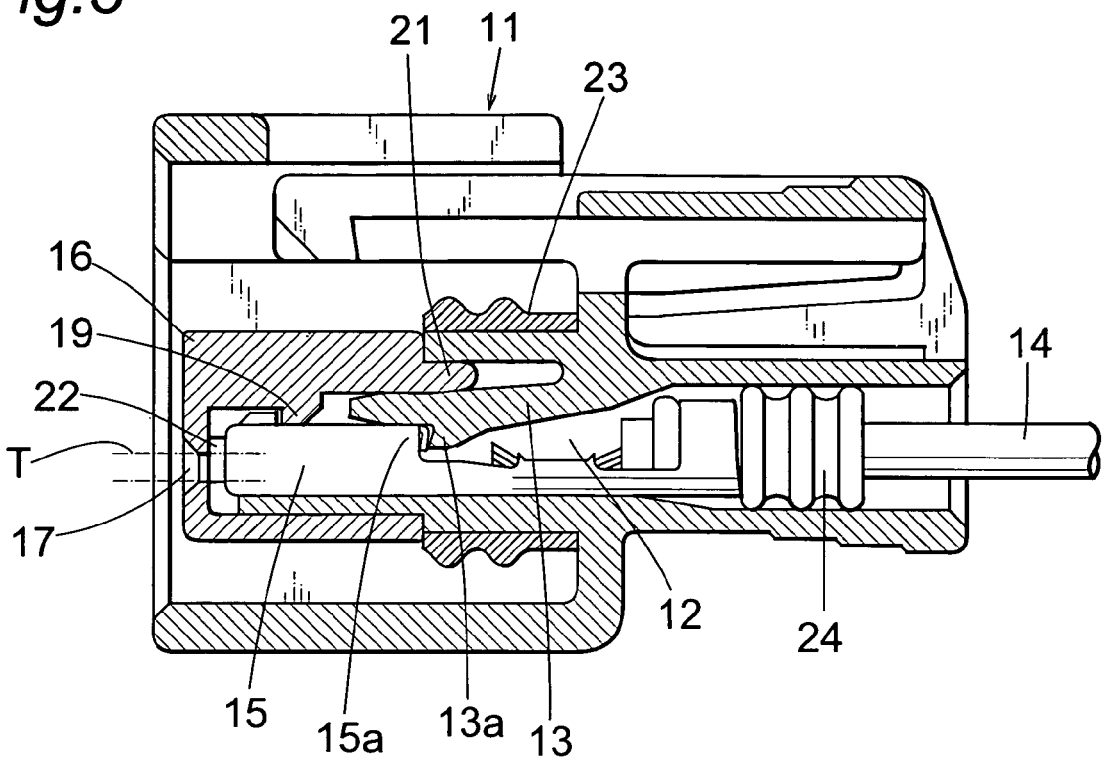
FIG. 3 is a similar cross sectional view cut along a B—B line in FIG. 2.

FIGS. 1–3 show a first embodiment of the electrical connector according to the invention. FIG. 1 is a front view of a housing under a condition in which an associated housing may be engaged, FIG. 2 is a cross sectional view of the housing and front holder cut along an A—A line in FIG. 1, and FIG. 3 is a similar cross sectional view cut along a B—B line in FIG. 1.

Within a housing 11 made of a synthetic resin there are formed two terminal accommodating holes 12 and two locking arms 13 in which a resilient force is provided downward are formed above the respective terminal accommodating holes 12. Within the terminal accommodating holes 12, female-type connecting terminals 15 having electric wires 14 connected thereto are inserted from a rear side of the housing 11 such that rear ends of connecting portions 15*a* of the connecting terminals 15 are engaged with claw portions 13*a* of the locking arms 13 to prevent undesired removal of the connecting terminals 15 in the backward direction. It should be noted that in the drawings, any connecting terminal 15 is not inserted into one of the terminal accommodating holes 12.

A front holder 16 made of a synthetic resin is inserted into a front portion of the housing 11, and the front holder 16 has formed therein terminal inserting holes 17 through which cooperating male-type connecting terminals are to be inserted, the number of said terminal inserting holes 17 being identical with that of the terminal accommodating holes 12. The front holder 16 further has arm operating holes 18 through which a suitable jig for operating the locking arms 13 is to be inserted, the number of the arm operating holes 18 being identical with that of the terminal inserting holes 17. In the present embodiment, two female-type connecting terminals 15 are installed within the housing and the number of the terminal inserting holes 17 and arm operating holes 18 formed in the front holder is also two.

The front holder 16 is engaged with the housing 11 in an axial direction by means of an engagement mechanism 19 shown in FIG. 3. The front holder 16 is movable relative to the housing 11 in a lateral direction perpendicular to the axial direction, i.e. in a direction perpendicular to a direction in which the connecting terminal 15 and locking arm 13 are arranged. As illustrated in FIG. 1, the terminal inserting hole 17 and arm operating hole 18 for the same connecting terminal 15 are relatively shifted in the lateral direction. In a first position of the front holder 16 shown in FIGS. 1–3, the terminal inserting hole 17 is aligned with the axis of the female-type connecting terminal 15, and therefore the arm inserting hole 18 is shifted laterally out of the locking arm 13. In the first position, in order to prevent the front holder 16 from further moving in a right direction, a wall 20 is formed in a left side portion of the front holder 16. The front holder 16 is locked to the housing 11 by a lock mechanism.

At a front portion of the front holder 16 there are formed arm pushing portions 21 in the form of projection at positions corresponding to the respective locking arms 13. As will be explained later, when the front holder 16 is moved from a second position into the first position, the arm pushing portions 21 are inserted above the locking arms 13 in a lateral direction and push the locking arms 13 downward such that the locking arms 13 can positively lock the connecting terminals 15 in position. Furthermore, at side portions of the terminal inserting holes 17 facing the connecting terminals 15 there are formed terminal pushing portions 22 for pushing the front ends of the connecting terminals 15 backward, and inclined portions 22*a* are formed in lower edges of the terminal pushing portions 22.

At the front end of the front holder 16, there is provided a cylindrical sealing member 23 which is brought into contact with a cooperating housing to constitute a water proof sealing. The electric wires 14 connected to the female-type connecting terminals 15 are covered with sealing members 24. It should be noted that the terminal accommodating holes 12 have an elongated elliptical cross sectional shape and the sealing members 24 for the electric wires 14 are deformed into a corresponding cross sectional shape.

Figure 4:
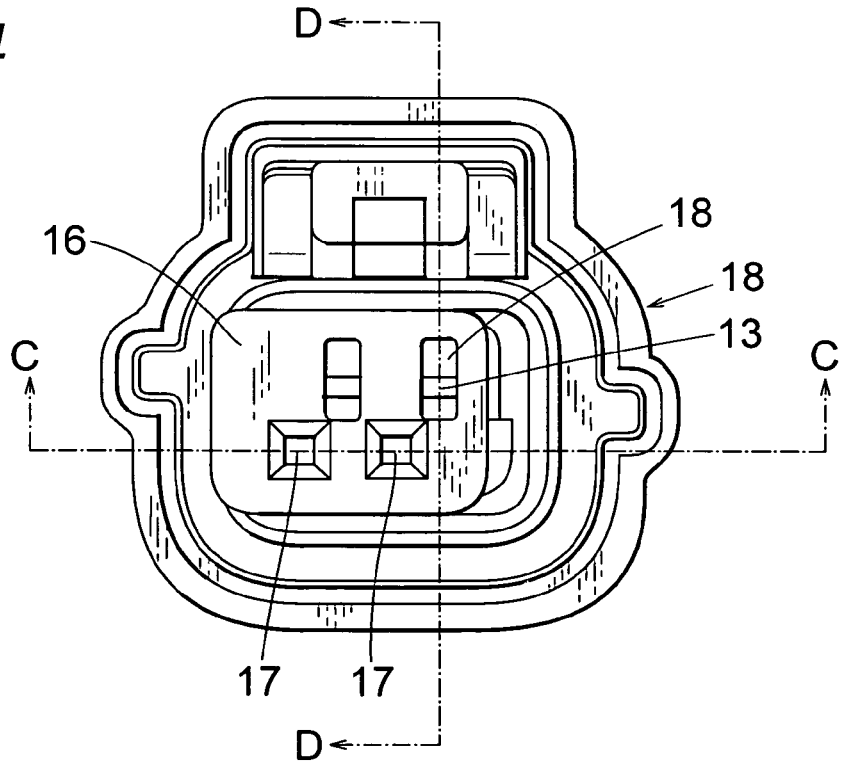
FIG. 4 is a front view where the front holder is in a second position.
Figure 5:
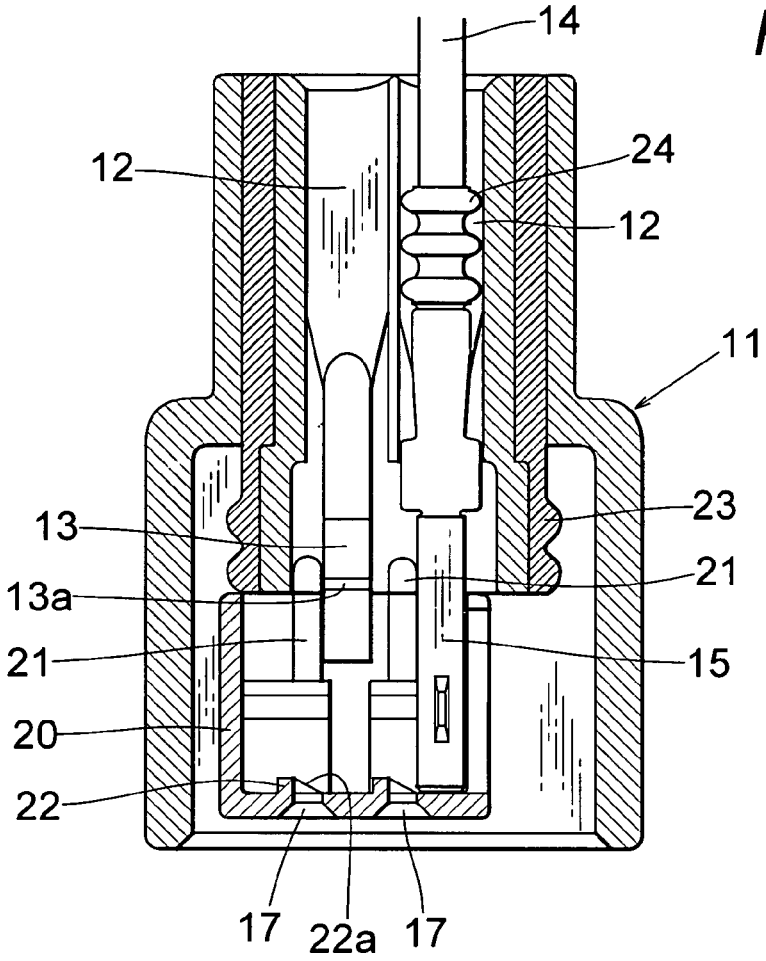
FIG. 5 is a cross sectional view cut along a C—C line in FIG. 4 showing the font holder and housing.
Figure 6:
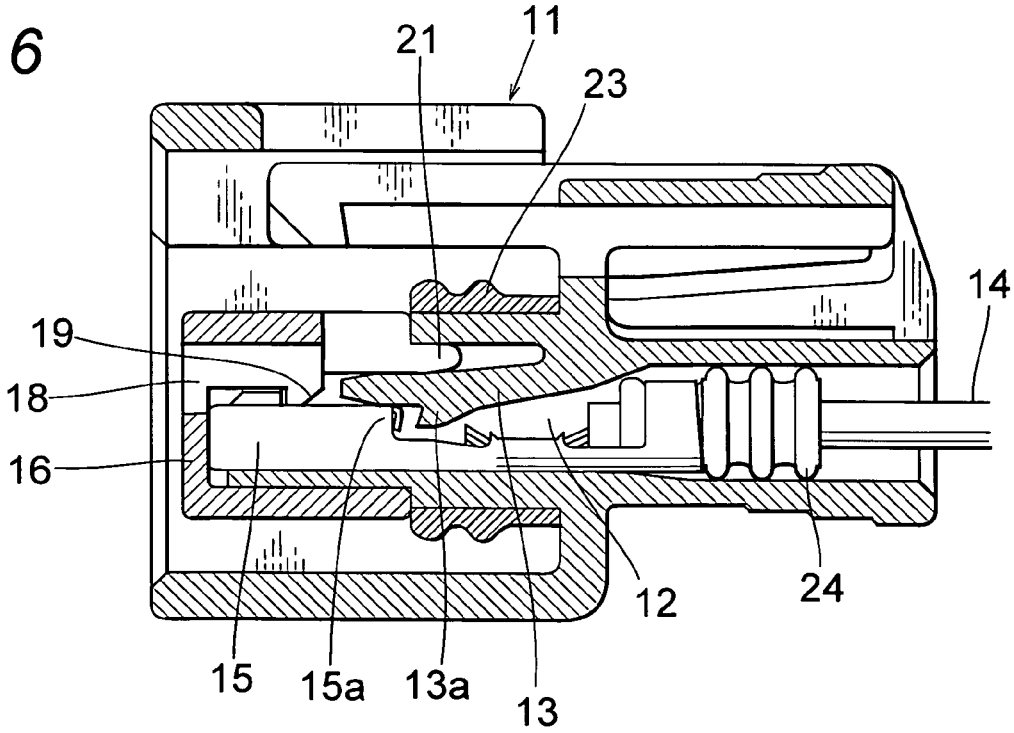
FIG. 6 is a similar cross sectional view cut along a D—D line in FIG. 4.

FIG. 4 is a front view of the front holder 16 inserted into the housing 11 under a condition that the front holder 16 has been removed from the first position shown in FIGS. 1–3 into a second position. FIG. 5 is a cross sectional view of the housing and front holder cut along a C—C line in FIG. 4 and FIG. 6 is a similar cross sectional view cut along a D—D line in FIG. 4. It should be noted that the front holder 16 may be temporally stopped or retained at the second position.

When the front holder 16 is in the second position, the terminal inserting holes 17 are not aligned with an axial line of the female-type connecting terminals 15 and the arm operating holes 18 are positioned in front of the respective locking arms 13. Therefore, the arm pushing portions 21 are not situated above the locking arms 18, and thus the locking arm 13 shown in FIG. 6 may be pushed upward by means of a jig inserted into the housing through the arm inserting hole 18 to release the engagement of the locking arm 13 with the connecting terminal 15, and therefore the connecting terminal 15 may be removed from the housing 11 backwardly.

When the female-type connecting terminals 15 are to be inserted into the housing 11, the front holder 16 is temporally retained in the second position, and then the connecting terminals 15 are inserted into the housing 11. During this inserting operation, a connecting portion 15*a* of a connecting terminal 15 pushes the resilient locking arm 13 upward, and when the connecting terminal 15 has been fully inserted into the terminal accommodating hole 12, the connecting portion 15*a* of the connecting terminal 15 is urged against an inner wall of the front holder 16 and could not be inserted any more. At the same time, the locking arm 13 is returned downward and a claw portion 13*a* situates just behind the connecting portion 15*a* of the connecting terminal 15.

After inserting all connecting terminals 15 into the respective terminal accommodating holes 12, the front holder 16 is moved from the second position in a right direction into the first position. During this lateral movement of the front holder 16, the arm pushing portions 21 of the front holder 16 are slipped above the locking arms 13 to push the locking arms downward such that the upward movement of the locking arms 13 is prevented and the engagement of the locking arms 13 with the connecting terminals 15 is positively attained.

Figure 7:
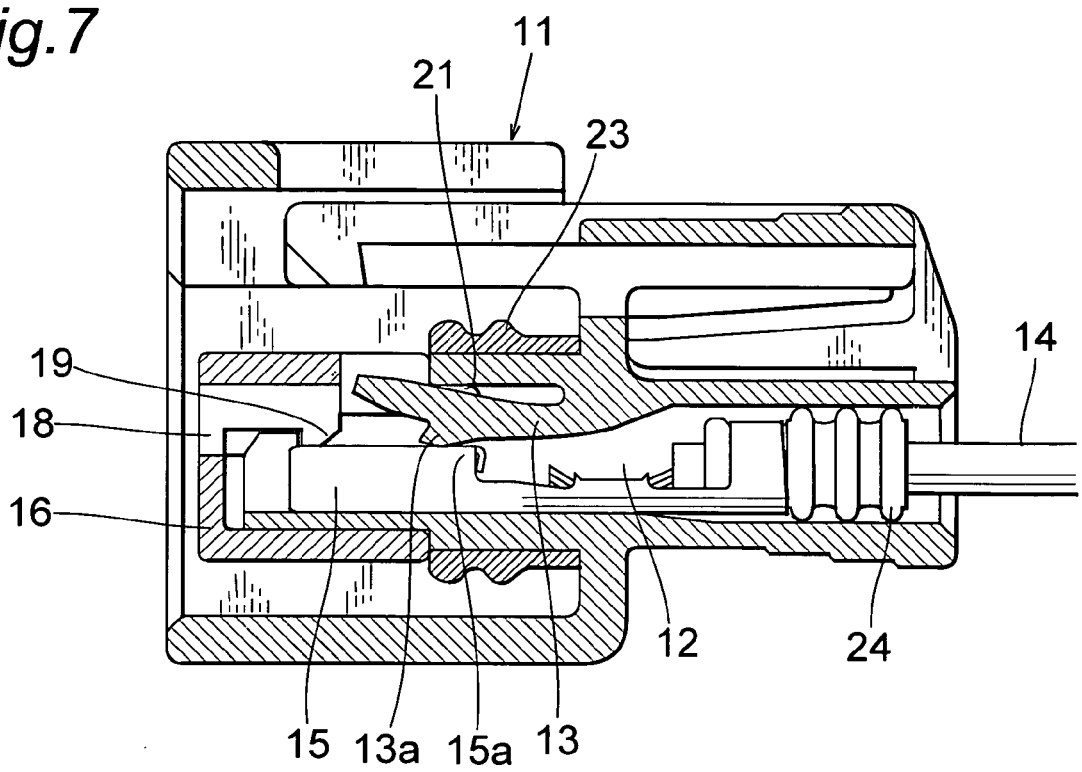
FIG. 7 is a cross sectional view similar to FIG. 6 showing a condition in which connecting terminals are not fully inserted into the housing.

When the front holder 16 is in the second position shown in FIGS. 4–6, if a connecting terminal 15 is not sufficiently inserted into a terminal accommodating hole 12, a locking arm 13 is brought into contact with the relevant connecting terminal 15 and could not be returned into a lower position as illustrated in FIG. 7, and the front holder 16 could not be moved into the first position, because an arm pushing portion 21 of the front holder 16 is brought into contact with the locking arm 13. In this manner, a user can know that at least one connecting terminal 15 has not been correctly inserted into a given position.

Figure 8:
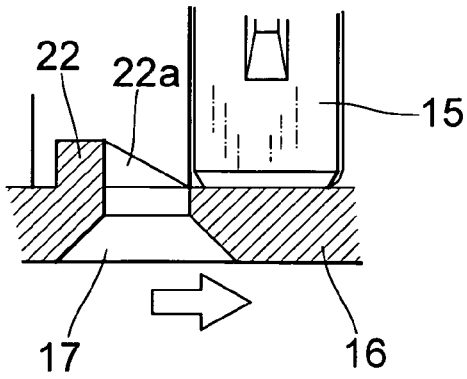
FIG. 8 is an explanatory drawing depicting an operation for pushing the connecting terminals by terminal pushing portions.
Figure 9:
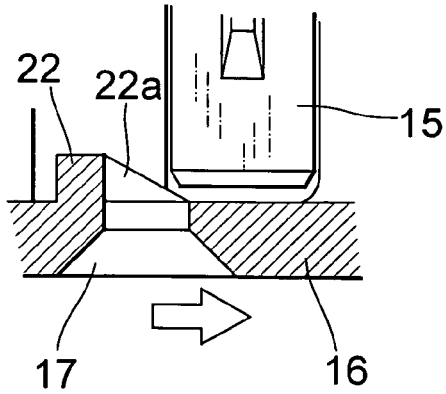
FIG. 9 is an explanatory drawing depicting the operation for pushing the connecting terminals by the terminal pushing portions.
Figure 10:
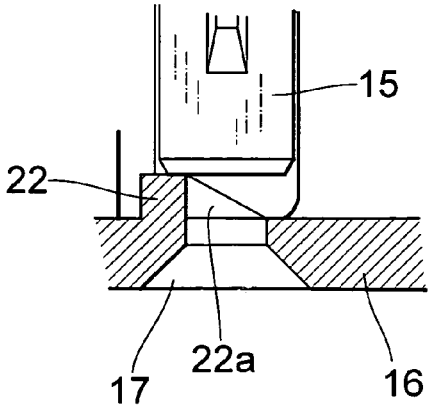
FIG. 10 is an explanatory drawing depicting the condition in which the connecting terminals have been pushed by the terminal pushing portions.

When the front holder 16 is moved from the second position into the first position, the inclined portions 22*a* of the terminal pushing portions 22 of the front holder 16 are brought into contact with the front ends of the female-type connecting terminals 15 as depicted in FIG. 8, and the connecting terminals 15 are pushed backward through a condition shown in FIG. 9 and FIG. 10 into a position in which the rear ends of the connecting portions 15*a* of the connecting terminals 15 are positively brought into contact with the claw portions 13*a* of the locking arms 13. In this manner, the connecting terminals 15 can be positively retained within the terminal accommodating holes 12 without causing undesired rotational movement.

Now the front holder 16 is in the condition shown in FIGS. 1–3, in which the terminal inserting holes 17 are aligned with the axial lines of the female-type connecting terminals 15 and the front ends of the locking arms 13 are closed by the front holder 16. In this condition, when a cooperating housing is clamped into the housing 11, the male-type connecting terminals T installed within the cooperating housing are inserted into the female-type connecting terminals 15 via the terminal inserting holes 17. Since the locking arms 13 are pushed downward by the arm pushing portions 21 of the front holder 16 and the connecting terminals 15 are pushed backward by the terminal pushing portions 22, a positive electrical connection can be attained between the connecting terminals 15 and the male-type connecting terminals T without causing rotational movement of the connecting terminal 15.

When it is required to remove a female-type connecting terminal 15 from the housing 11, the front holder 16 is moved leftward into the second position shown in FIGS. 4–6. Then, the arm operating holes 18 are aligned with the locking arms 13 and the connecting terminals 15 are closed by the front holder 16. Therefore, an operator can insert an elongated jig into a desired arm operating hole 18 to release an engagement of the relevant locking arm 13 with an associated connecting terminal 15 without fail.

In the present embodiment, the connecting terminals installed within the housing are of the female-type, but according to the invention, they may be of the male-type. In such a case, female-type connecting terminals are inserted through the terminal inserting holes 17 of the front holder 16, and therefore the terminal inserting holes may advantageously have a larger width such that the front holder 16 can move between the first and second positions and the arm operating holes 18 are aligned with the locking arms 13 only in the second position.

In this manner, at least in the first position, the arm operating holes 18 are not aligned with the locking arms 13 and the male-type connecting terminals can be positively engaged with the locking arms 13 by means of the arm pushing portions 21. Moreover, the male-type connecting terminals can be pushed backward by the terminal pushing portions 22 like as the female-type connecting terminals 15 such that the male-type connecting terminals can be urged against the locking arms 13 to prevent a rotational movement of the connecting terminals.

The above mentioned embodiment includes all of the three functions, i.e. the terminal inserting hole and arm operating hole is relatively shifted, the locking arms 13 are pushed by the arm pushing portions 21 and the connecting terminals 15 are pushed by the terminal pushing portions 22. Although these three functions are common to the movement of the front holder 16 in the right and left directions, but they may be realized separately or independently.

Figure 11:
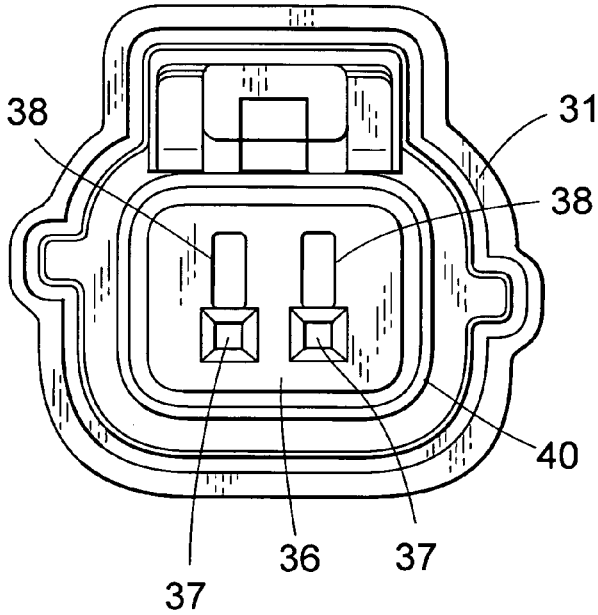
FIG. 11 is a front view of a second embodiment of the electrical connector according to the invention, in which the front holder is in the first position.
Figure 12:
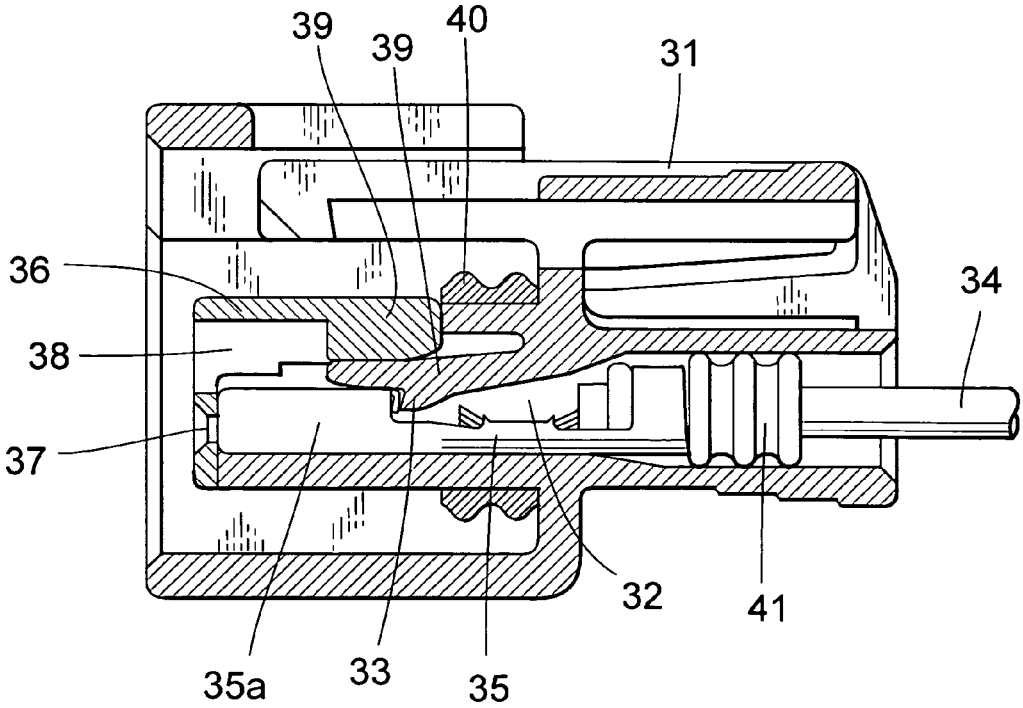
FIG. 12 is a longitudinal cross sectional view in which the front holder is in the first position.

FIGS. 11 and 12 illustrate a second embodiment of the electrical connector according to the invention. FIG. 11 is a front view of the connector under a condition that associated or cooperating connecting terminals may be inserted, and FIG. 12 is a longitudinal cross sectional view.

Within a housing 31 made of a synthetic resin there are formed, for instance two terminal accommodating holes 32 arranged side by side, and two locking arms 33 are formed above the respective terminal accommodating holes 32, said locking arms 33 being resiliently deformed upward. Within the terminal accommodating holes 32, female-type connecting terminals 35 having electric wires 34 connected thereto are inserted from a rear side of the housing 31 such that rear portions of connecting portions 35*a* of the connecting terminals 35 are engaged with claw portions 33*a* of the locking arms 33 to prevent undesired removal of the connecting terminals 35 in the backward direction.

A front holder 36 made of a synthetic resin is inserted into a front portion of the housing 31, and the front holder 36 has formed therein terminal inserting holes 37 through which cooperating male-type connecting terminals are to be inserted, the number of said terminal inserting holes 37 being identical with that of the terminal accommodating holes 32. In the front holder 36, there are further formed arm operating holes 38 above the respective terminal inserting holes 37, the number of said arm operating holes 38 being identical with that of the terminal inserting holes 37. A suitable jig for operating a locking arm 33 may be inserted into an associated arm operating hole 38. Also in the present embodiment, two female-type connecting terminals 35 are installed within the housing and the number of the terminal inserting holes 37 and arm operating holes 38 formed in the front holder is also two.

The front holder 36 is engaged with the housing 31 in an axial direction by means of an engagement mechanism not shown in the drawings. The front holder 36 is movable relative to the housing 31 in an up and down direction perpendicular to the axial direction, i.e. in a direction in which the connecting terminal 35 and locking arm 33 are arranged. In a first position of the front holder 36 shown in FIGS. 11 and 12, the terminal inserting hole 37 is aligned with the axis of the female-type connecting terminal 35 and the arm inserting hole 38 is slightly shifted relative to the locking arm 33 in an up and down direction. In the first position, in order to prevent the front holder 36 from further moving in a down direction, there is formed a limiting member not shown in the drawings. The front holder 36 is locked to the housing 31 by a lock mechanism not shown in the drawings.

Within the housing 31, there is provided a cylindrical sealing member 40 at the front end of the front holder 36, said sealing member 40 being brought into contact with a cooperating housing to constitute a water proof sealing. The electric wires 34 connected to the female-type connecting terminals 35 are covered with sealing members 41.

Figure 13:
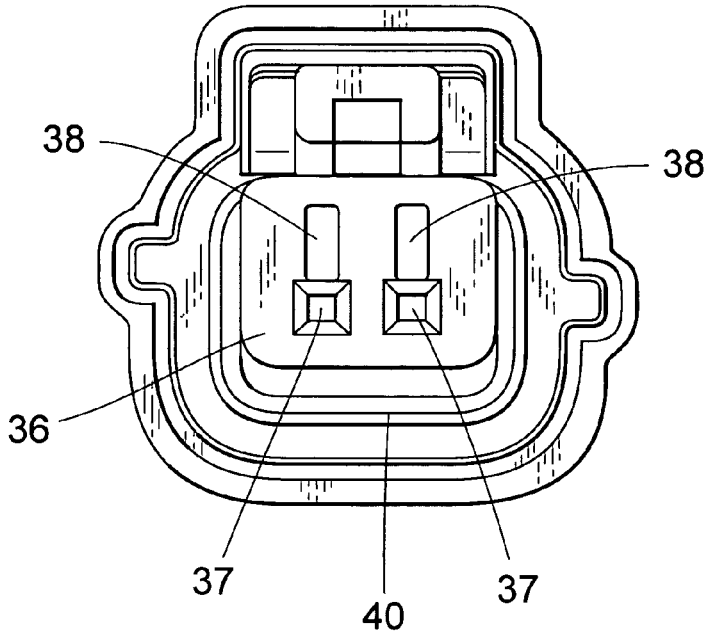
FIG. 13 is a front view in which the front holder is in the second position.
Figure 14:
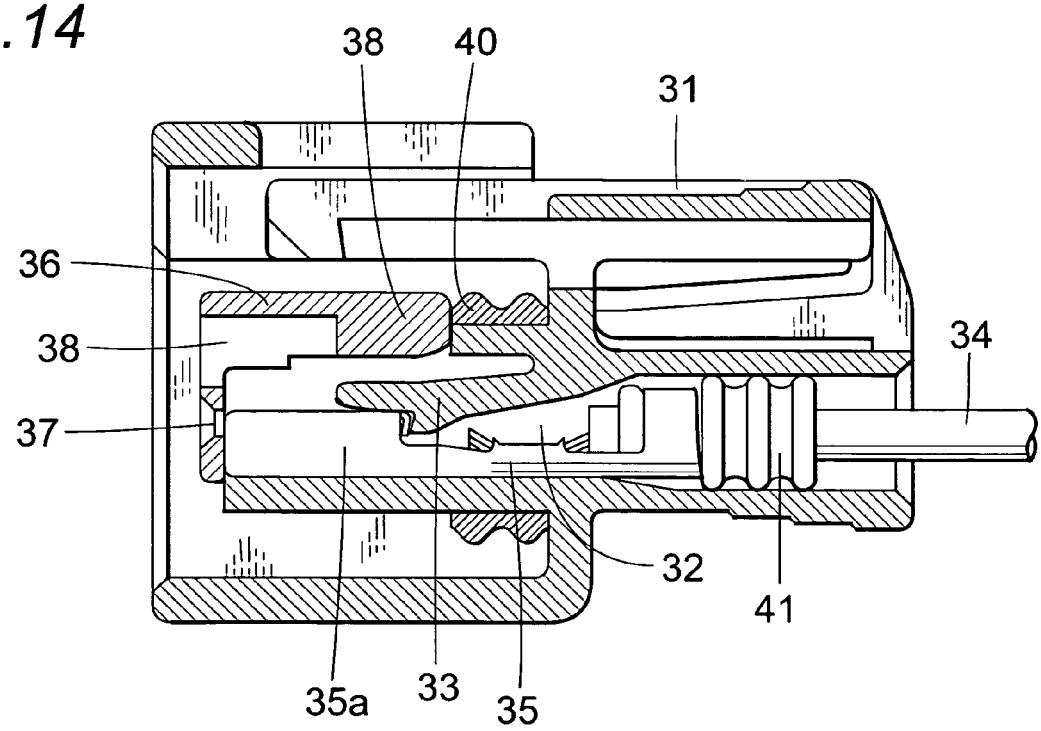
FIG. 14 is a longitudinal cross section, in which the front holder is in the second position.
Figure 15:
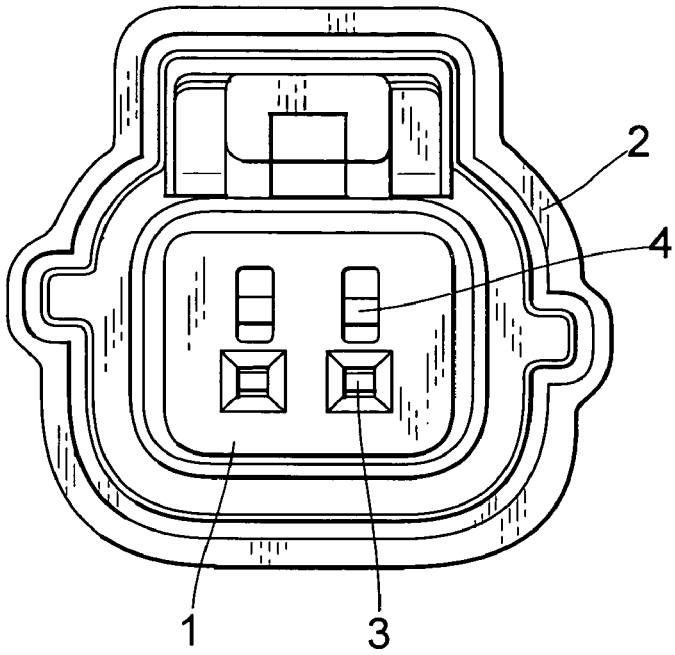
FIG. 15 is a front view illustrating a known electrical connector.
Figure 16:
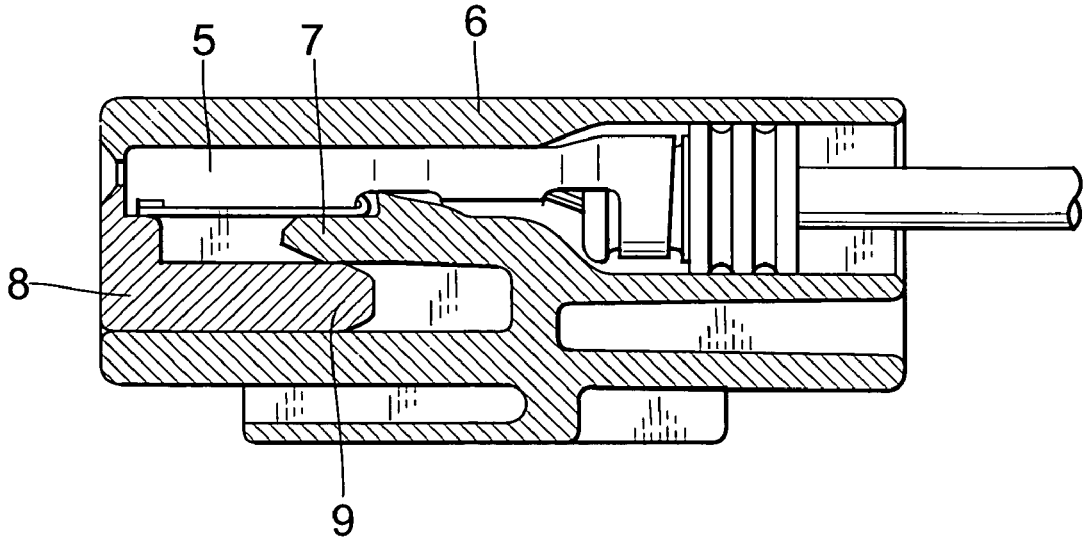
FIG. 16 is a longitudinal cross sectional view showing another known electrical connector.

FIG. 13 is a front view of the front holder 36 inserted into the housing 31. That is to say, the front holder 36 is removed from the first position shown in FIGS. 11 and 12 into a second position. FIG. 14 is a longitudinal cross sectional view of the housing and front holder. In the second position, the front holder 36 may be temporally stopped or retained.

When the front holder 36 is in the second position, the terminal inserting holes 37 are not aligned with an axial line of the female-type connecting terminals 35 viewed in an up and down direction, and therefore even if a cooperating housing is clamped, male-type connecting terminals might not be inserted into the terminal inserting holes 37. The arm operating holes 38 are positioned in front of the respective locking arms 33. Therefore, the locking arms 33 are released from the arm pushing portions 39, and thus the locking arm 33 shown in FIG. 14 may be pushed upward by means of a jig inserted into the housing through the arm operating hole 38 to release the engagement of the locking arm 33 with the connecting terminal 35, and the connecting terminal 35 may be removed from the housing 31 backwardly.

When the female-type connecting terminals 35 are to be inserted into the housing 31, the front holder 36 is temporally retained in the second position, and then the connecting terminals 35 are inserted into the terminal accommodating holes 32. During this inserting operation, a connecting portion 35*a* of a connecting terminal 35 pushes the resilient locking arm 33 upward, and when the connecting terminal 35 has been fully inserted into the terminal accommodating hole 32, a front end of the connecting portion 35*a* of the connecting terminal 35 is urged against an inner wall of the front holder 36 and could not be inserted any more. At the same time, the locking arm 33 is returned downward and a claw portion 33*a* situates just behind the connecting portion 35*a* of the connecting terminal 33.

After inserting all connecting terminals 35 into the respective terminal accommodating holes 32, the front holder 36 is moved downward from the second position into the first position. During this downward movement of the front holder 36, the arm pushing portions 39 of the front holder 36 push the locking arms 33 downward such that the upward movement of the locking arms 33 is prevented and the engagement of the locking arms 33 with the connecting terminals 35 is positively attained.

When the front holder 36 is in the second position shown in FIGS. 13 and 14, if a connecting terminal 35 is not sufficiently inserted into a terminal accommodating hole 32, a locking arm 33 is brought into contact with the connecting portion 35*a* of the relevant connecting terminal 35. Therefore, the front holder 36 could not be moved into the first position, because the arm pushing portion 39 of the front holder 36 is brought into contact with the locking arm 33. In this manner, a user can know that at least one connecting terminal 35 has not been correctly inserted into a given position.

When the front holder 36 is moved into the first position shown in FIGS. 11 and 12, the terminal inserting holes 37 are aligned with the axial lines of the female-type connecting terminals 35 and the locking arms 33 are shifted from the arm operating holes 38. When a cooperating housing is clamped into the housing 31 under such a condition, the male-type connecting terminals installed within the cooperating housing are inserted into the female-type connecting terminals 35 via the terminal inserting holes 37. Since the locking arms 33 are pushed downward by the arm pushing portions 39 of the front holder 36 and the connecting terminals 35 are pushed backward by the terminal pushing portions 22, even if a jig is erroneously inserted into an arm operating hole 38, a locking arm 33 could not be moved and the engagement of the locking arm 33 with a connecting terminal 35 could be released.

When it is required to remove a female-type connecting terminal 35 from the housing 31, the front holder is disengaged from the housing and the front holder 36 is moved upward into the second position shown in FIGS. 13 and 14. Then, the arm operating holes 38 are moved in front of the locking arms 33 and the arm pushing portions 39 are moved upward. Since the connecting terminals 35 are shifted from the terminal inserting holes 37, a user might not insert a jig into a connecting terminal 35 via a terminal inserting hole 37, and can insert a jig into the housing 31 through an arm operating hole 38 and an engagement of a locking arm 33 with a connecting terminal 35 can be released.

Applicability in the Industrial Field

As explained above, in the electrical connector according to the invention, since the terminal inserting holes and arm operating holes are relatively shifted and the front holder is moved, the terminal inserting holes and arm operating holes could not work simultaneously, and thus an operation can be performed safely.

In the electrical connector according to the invention, the locking arms are fixed by moving the front holder, and the engagement of a locking arm and a connecting terminal can be released by inserting a jig through an arm operating hole.

Furthermore, in the electrical connector according to the invention, by moving the front holder, the arm pushing portions can prevent the locking arms from disengaging from the connecting terminals.

In the electrical connector according to the invention, by moving the front holder, the connecting terminals are pushed backward by the terminal pushing portions such that the connecting terminals can be positively engaged with the locking arms and the connecting terminals could not be rotated.

What is claimed is:

1. An electrical connector comprising a housing having a plurality of terminal accommodating holes for accommodating a plurality of connecting terminals connected to distal ends of electric wires and a plurality of locking arms each of which is engaged with a respective one of said connecting terminals not to remove backwardly, and a front holder which is engaged with a front portion of the housing and includes a plurality of terminal inserting holes through which cooperating connecting terminals are to be inserted and a plurality of arm pushing portions each of which is urged against a respective one of said locking arms to enhance a locking force of the locking arms, wherein said front holder has formed therein a plurality of arm operating holes through each of which a jig for operating the locking arms is to be inserted, and a plurality of said terminal inserting holes independently, said front holder is movable lineally in a plane parallel to a front surface of said housing in a direction along an axial line between said terminal inserting holes and said arm operating holes corresponding to a first position and a second position; in said first position of the front holder, said plurality of locking arms are pushed toward connecting terminals by said plurality of arm pushing portions and said plurality of terminal inserting holes are aligned with said plurality of connecting terminals such that an electrical connection between the connecting terminals and cooperating electrical terminals is attained by engaging a cooperating housing; and in said second position of the front holder, said front holder is temporarily engaged with said housing, said front holder releases arm pushing portions of said locking arms, said plurality of terminal inserting holes are shifted out of the axial lines of the connecting terminals installed within the housing, said plurality of arm operating holes are aligned with said plurality of locking arms, and said plurality of arm pushing portions are removed from said plurality of locking arms such that a locking operation of a locking arm is released by inserting the jig into an arm operating hole and a connecting terminal can be removed from a terminal accommodating hole.

2. The electrical connector according to claim 1, wherein said front holder has formed therein a plurality of terminal pushing portions which push said connecting terminals backward to engage said plurality of locking arms with said plurality of connecting terminals in the axial direction without play when said front holder is moved from said second position into said first position.

3. An electrical connector comprising a housing having a plurality of terminal accommodating holes for accommodating a plurality of connecting terminals connected to distal ends of electric wires and a plurality of locking arms each of which is engaged with a respective one of said connecting terminals not to remove backwardly, and a front holder which is engaged with a front portion of the housing and includes a plurality of terminal inserting holes through which cooperating connecting terminals are to be inserted and a plurality of arm pushing portions each of which is urged against a respective one of said locking arms to enhance a locking force of the locking arms, wherein said front holder has formed therein a plurality of arm operating holes through each of which a jig for operating the locking arms is to be inserted, said front holder is movable with respect to said housing in a direction along an axial line between said terminal inserting holes and said arm operating holes corresponding to a first position and a second position; in said first position of the front holder, said plurality of locking arms are pushed toward connecting terminals by said plurality of arm pushing portions and said plurality of terminal inserting holes are aligned with said plurality of connecting terminals such that an electrical connection between the connecting terminals and cooperating electrical terminals is attained by engaging a cooperating housing; and in said second position of the front holder, said front holder is temporarily engaged with said housing, said plurality of terminal inserting holes are shifted out of the axial lines of the connecting terminals installed within the housing, said plurality of arm operating holes are aligned with said plurality of locking arms, and said plurality of arm pushing portions are removed from said plurality of locking arms such that a locking operation of a locking arm is released by inserting the jig into an arm operating hole and a connecting terminal can be removed from a terminal accommodating hole, wherein said front holder has formed therein a plurality of terminal pushing portions which push said connecting terminals backward to engage said plurality of locking arms with said plurality of connecting terminals in the axial direction without play when said front holder is moved from said second position into said first position, and wherein each of said terminal pushing portions includes an inclined portion by means of which each of said connecting terminals is gradually pushed backward.

4. The electrical connector according to claim 1, wherein in said first position, said front holder is engaged with said housing by means of a locking member.

* * * * *